US009406425B2

(12) United States Patent
Sheflyand

(10) Patent No.: US 9,406,425 B2
(45) Date of Patent: Aug. 2, 2016

(54) MAGNETIC DECOUPLING UNIT FOR RELEASING ANTITHEFT DEVICES

(71) Applicant: Checkpoint Systems, Inc., Thorofare, NJ (US)

(72) Inventor: Felix B. Sheflyand, Mayfield Heights, OH (US)

(73) Assignee: CHECKPOINT SYSTEMS INC., Thorofare, NJ (US)

( * ) Notice: Subject to any disclaimer, the term of this patent is extended or adjusted under 35 U.S.C. 154(b) by 0 days.

(21) Appl. No.: 14/286,058

(22) Filed: May 23, 2014

(65) Prior Publication Data

US 2015/0340142 A1 Nov. 26, 2015

(51) Int. Cl.

| | |
|---|---|
| ***H01F 7/04*** | (2006.01) |
| ***E05B 73/00*** | (2006.01) |
| ***H01F 7/02*** | (2006.01) |

(52) U.S. Cl.

CPC ..... *H01F 7/04* (2013.01); *E05B 73/0052* (2013.01); *H01F 7/02* (2013.01)

(58) Field of Classification Search

CPC ..... E05B 73/0052–73/0058; H01F 7/04
USPC ..... 70/57.1; 340/572.9; 335/306; 24/303
See application file for complete search history.

(56) References Cited

U.S. PATENT DOCUMENTS

| | | | | |
|---|---|---|---|---|
| 5,197,706 | A * | 3/1993 | Braithwaite | E05B 73/0005 248/499 |
| 8,305,177 | B2 | 11/2012 | Li et al. | |
| 2010/0176903 | A1 | 7/2010 | Li et al. | |
| 2010/0188227 | A1 | 7/2010 | Yang | |
| 2011/0090033 | A1 | 4/2011 | Sankar | |

FOREIGN PATENT DOCUMENTS

| | | |
|---|---|---|
| NL | 1019660 C2 | 7/2003 |

OTHER PUBLICATIONS

Extended European Search Report and Written Opinion of corresponding European application No. 15168825.6 mailed Oct. 2, 2015.

* cited by examiner

*Primary Examiner* — Ramon Barrera
(74) *Attorney, Agent, or Firm* — Nelson Mullins Riley & Scarborough LLP

(57) ABSTRACT

A magnetic decoupling unit that is capable of magnetically releasing several types of magnetically releasable antitheft devices may include a magnet assembly. The magnet assembly may be placed inside a magnet housing with a cover that has an aperture and insert for receiving portions of a magnetically releasable antitheft device. The magnet assembly may include a first magnet with a vertical magnetic orientation which is surrounded by adjacent magnets with magnetic orientations that are orthogonal to the vertical magnetic orientation. Additionally, the magnet assembly includes one or more additional magnets oriented in the vertical and orthogonal directions. The resulting magnet assembly may be capable of magnetically releasing single clutch, double clutch, and electronic media type antitheft devices.

18 Claims, 4 Drawing Sheets

MAGNETIC DECOUPLING UNIT FOR RELEASING ANTITHEFT DEVICES

TECHNICAL FIELD

Example embodiments of the present invention generally relate to magnetically releasable antitheft devices and, more particularly, relate to a magnetic decoupling unit capable of removing several types of magnetically releasable antitheft devices.

BACKGROUND

Antitheft devices are designed to prevent unauthorized removal of an item from a secured location. These antitheft devices are commonly used, for example, in a retail sales environment such as a clothing store. The antitheft device is placed on an item such as an article of clothing and is removed by a store clerk after the customer has paid for the article. If someone tries to remove the article of clothing from the store without first removing the antitheft device, an alarm will sound or the store clerk will otherwise be notified.

Antitheft devices are often attached to the article of clothing using a magnetically releasable mechanism. This mechanism, a component of which may be, for example, a metal pin, locks the antitheft device onto the article of clothing such that it may only be removed when the antitheft device is in the presence of a magnetic field of sufficient strength and dimension to unlock the metal pin and allow its removal.

Magnetically releasable antitheft devices come in a variety of forms, each of which may require a slightly different magnetic "key" or "detacher" to unlock the device. For example, single pin or single clutch devices use a single locking pin which may be unlocked by a localized vertical magnetic field. By contrast a double clutch or double leaf spring devices may have two locations where a sufficient magnetic field is needed.

In order to prevent the theft of electronic media (e.g., DVDs, CDs, etc.) and other products, another type of antitheft device may be secured along the length of an edge of an electronic media case or other lockable unit. When in place, the antitheft device prevents the case from being opened to remove the media and will trip an alarm if removed from the store. To release this type of antitheft device, an elongated horizontal magnetic field may be used.

Because stores may use multiple types of antitheft devices, and because each antitheft device may require a different key or detacher to magnetically unlock and release it, it is desirable to have a single magnetic decoupling unit that can be used to magnetically release each of a plurality of common antitheft devices.

BRIEF SUMMARY OF SOME EXAMPLES

Some example embodiments of the present invention recognize and address considerations of prior art constructions and methods.

An example embodiment of a magnetic decoupling unit may include a magnet assembly for decoupling a plurality of different types of magnetically releasable antitheft devices. The magnet assembly may comprise a first magnet having a magnetic orientation along a first direction; a plurality of magnets adjacent to and surrounding the first magnet, the adjacent magnets defining an opening above the first magnet, each adjacent magnet having a magnetic orientation orthogonal to the first direction; a first side magnet disposed adjacent one of the magnets adjacent to the first magnet, the first side magnet having the same magnetic orientation as the first magnet.

Other aspects and advantages of the present invention will be apparent from the following description and the appended claims. Those skilled in the art will appreciate the scope of the present invention and realize additional aspects thereof after reading the following detailed description of example embodiments in association with the accompanying drawing figures.

BRIEF DESCRIPTION OF THE SEVERAL VIEWS OF THE DRAWING(S)

Having thus described example embodiments of the present invention in general terms, reference will now be made to the accompanying drawings, which are not necessarily drawn to scale, and wherein:

DETAILED DESCRIPTION

Reference will now be made in detail to example embodiments of the present invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations.

Example embodiments of the present invention relate to an improved magnetic decoupling unit for use with a plurality of different types of magnetically releasable antitheft devices. The magnetic decoupling unit includes a first magnet that may be centrally located and surrounded by a plurality of adjacent magnets and at least one side magnets. Some of the magnets are arranged with their magnetic orientations orthogonal to each other to increase the axial magnetic field through the superposition of the magnetic fields of each magnet. In addition, two side magnets (e.g., a first side magnet and a second side magnet) are included to increase the axial magnetic field as well as to provide an elongated, horizontally oriented magnetic field. When configured in this manner, the magnet assembly is capable of unlocking most common types of magnetically releasable antitheft devices.

Figure 1:
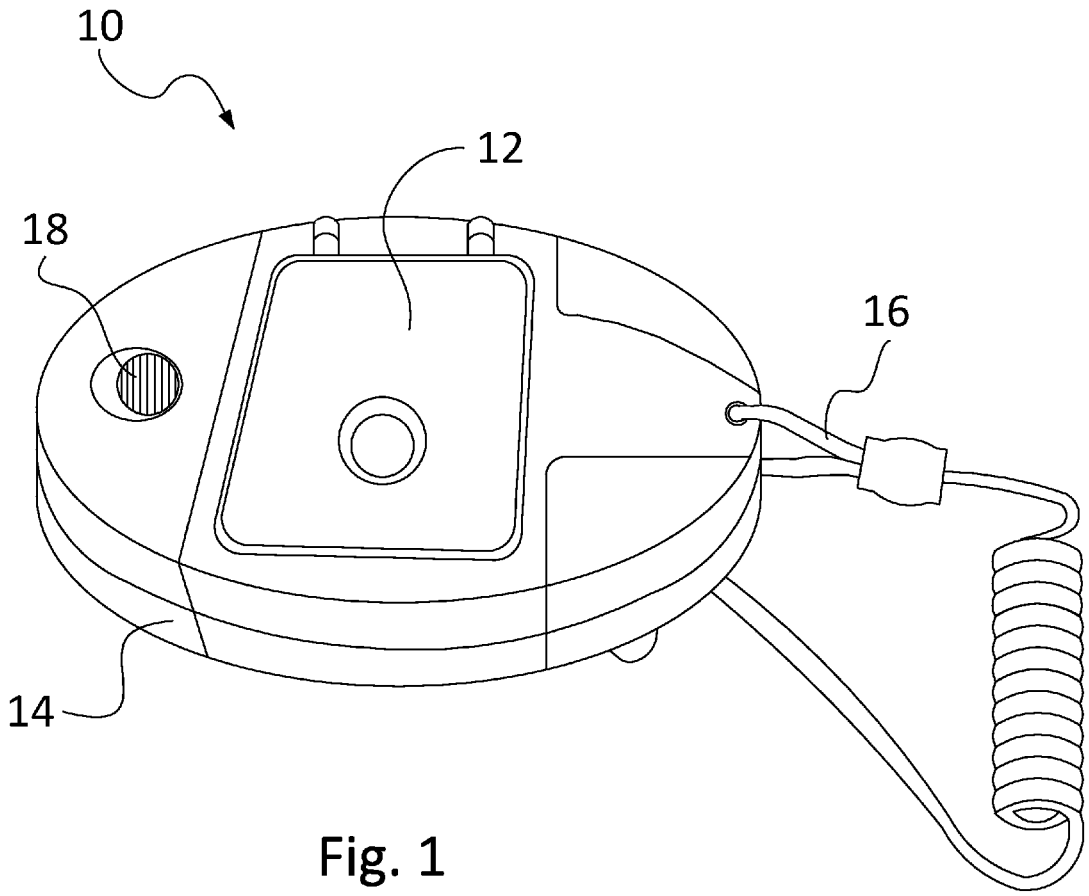
FIG. 1 illustrates a perspective view of an antitheft tag removal device containing a magnetic decoupling unit in accordance with an example embodiment of the present invention.

FIG. 1 shows an antitheft tag removal device 10 in accordance with an example embodiment of the present invention. The device 10 comprises a magnetic decoupling unit 12 which is connected to the device base 14 by a tether 16. As commonly used in a retail store, the device base 14 may be securely fixed or otherwise provided at the checkout counter beside a point of sale (POS) terminal. Antitheft devices are typically placed on the store merchandise and the antitheft device is removed by placing it on the magnetic decoupling unit 12 in the required orientation to release the internal locking mechanism. However, the store clerk can optionally remove the magnetic decoupling unit 12 from the base 14 by pressing the release button 18. This allows the clerk to use the magnetic decoupling unit 12 as a handheld device. When used in this manner, the tether 16, which is secured to the base 14, may ensure that the magnetic decoupling unit 12 is not removed from the checkout counter.

Figure 2:
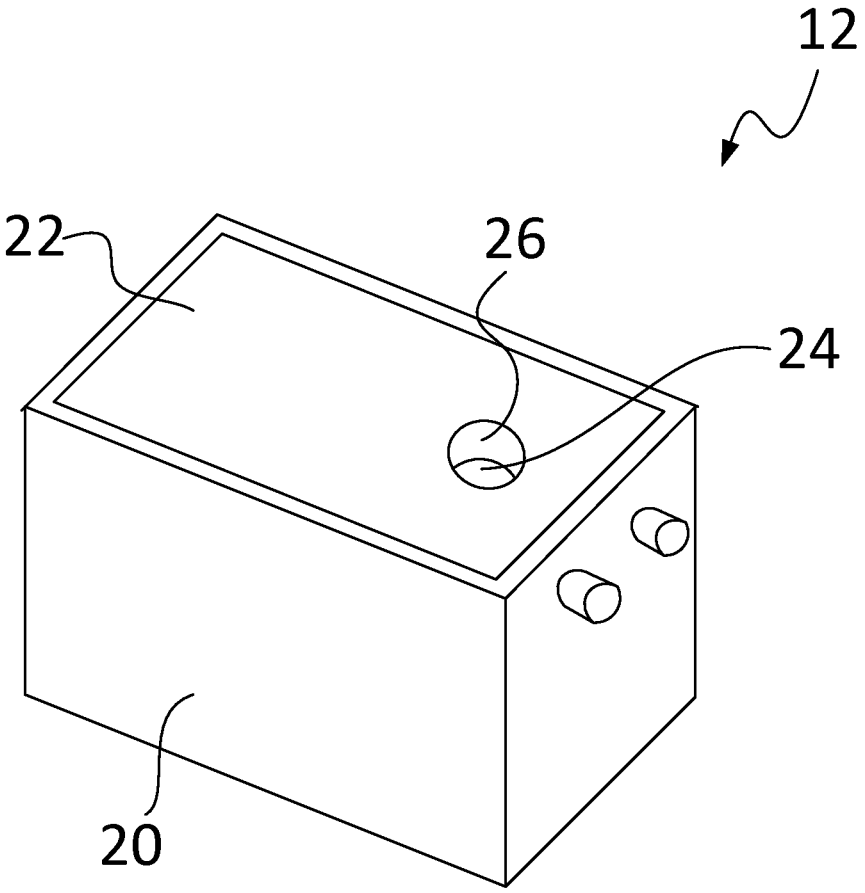
FIG. 2 illustrates a perspective side view of a magnetic decoupling unit in accordance with an example embodiment of the present invention.
Figure 3:
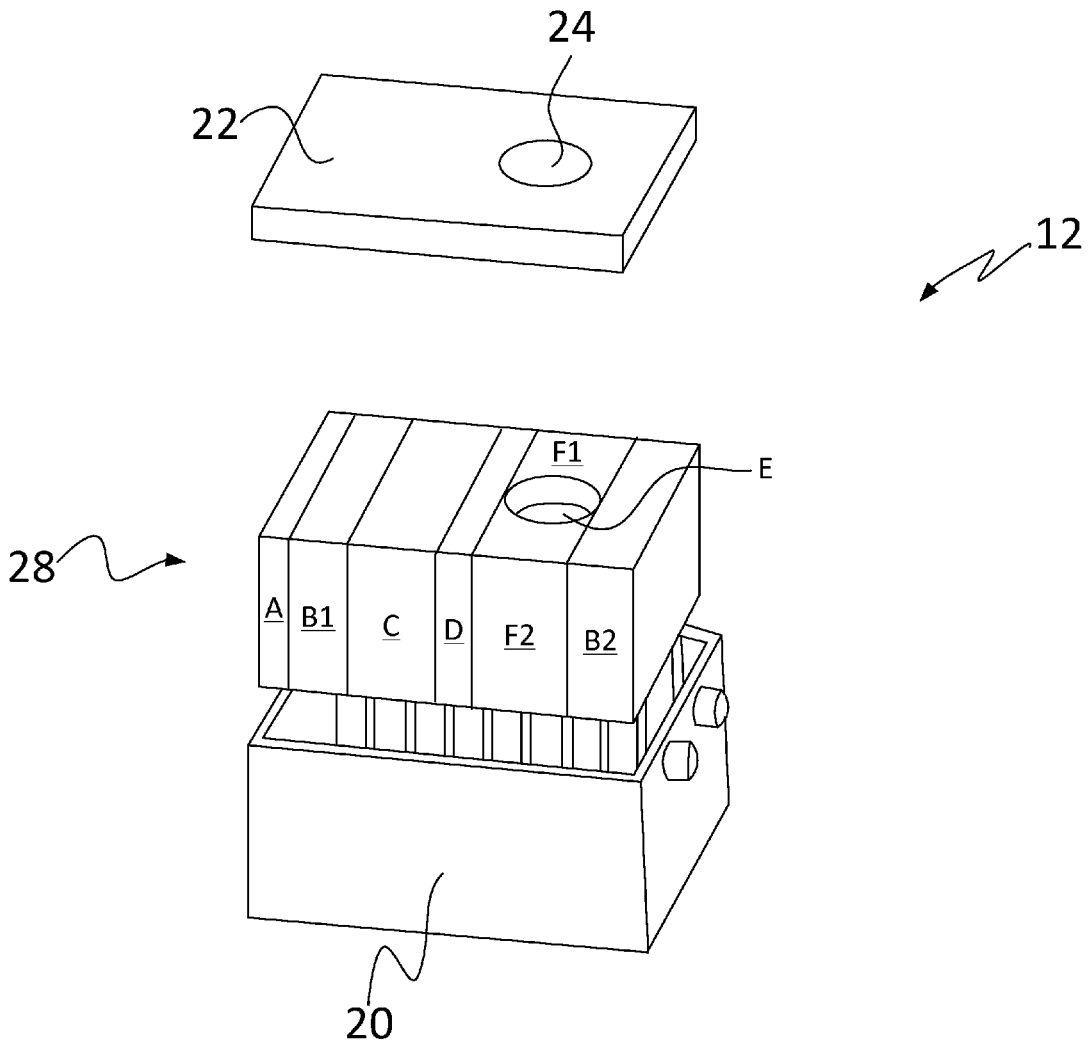
FIG. 3 illustrates an exploded perspective side view of a magnetic decoupling unit in accordance with an example embodiment of the present invention.

FIGS. 2 and 3 show an assembled and exploded view, respectively, of an exemplary magnetic decoupling unit 12 that might be fixed in the antitheft tag removal device 10 of FIG. 1. The magnet assembly 28 may be placed inside the magnet housing 20, which may be non-magnetic, being constructed from a non-ferromagnetic material such as plastic or stainless steel. The magnet assembly may also be covered by a housing cover 22 constructed from non-ferromagnetic material. The housing cover 22 may have an aperture 24 and insert 26, for example, for receiving single clutch antitheft tags.

Figure 4A:
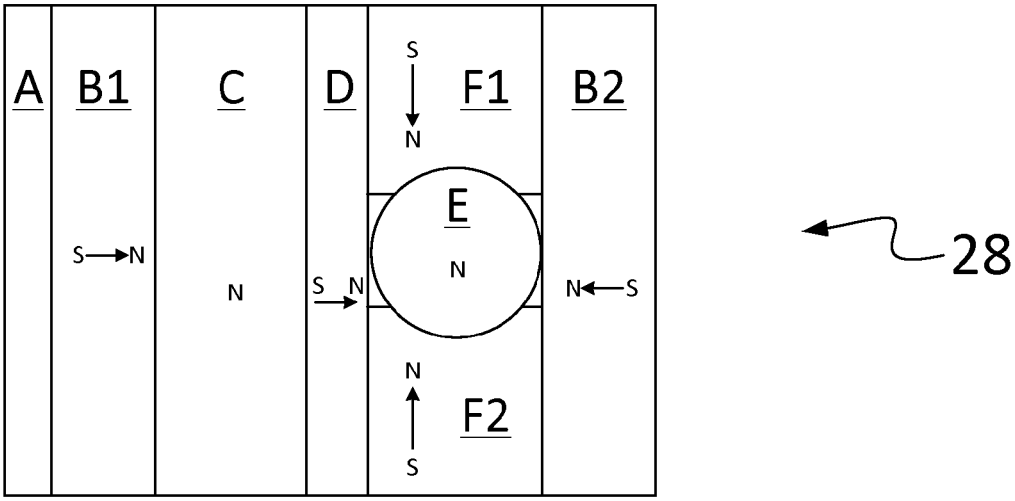
FIG. 4A illustrates a top view of a magnet assembly in accordance with an example embodiment of the present invention.
Figure 4B:
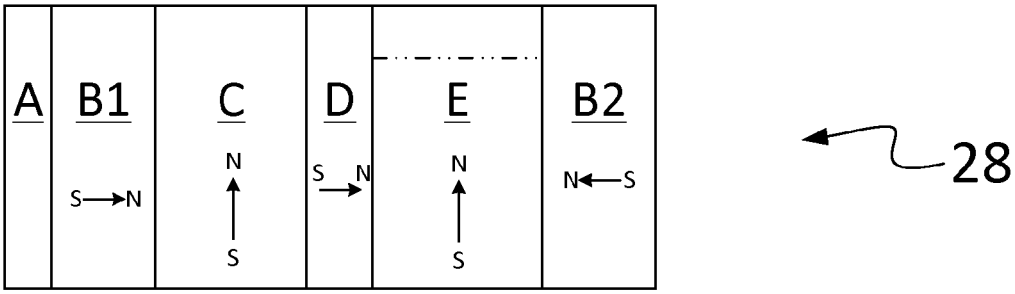
FIG. 4B illustrates a side view of a magnet assembly in accordance with an example embodiment of the present invention.

Referring now to FIGS. 4A and 4B, an example embodiment of the magnet assembly 28 may be comprised of seven magnets. A first magnet E is positioned below the cover aperture 24 and is magnetically oriented in a vertical direction (as can be seen from the magnetic orientation indicators). The first magnet E is shorter than the other magnets in the magnet assembly 28 in order to accommodate the insert 26 for receiving a single clutch antitheft tag. Four magnets—B2, D, F1, and F2—are arranged adjacent to the first magnet E. Each of these magnets is magnetically oriented in a direction orthogonal to the vertical orientation of the first magnet E and magnetically directed toward the first magnet E as shown in FIG. 4A. In this regard, the first magnet E may have the North pole oriented vertically upward, while the North poles of adjacent magnets D and B2 may each be oriented toward the first magnet E. The North poles of adjacent magnets F1 and F2 may also each be oriented toward the first magnet E. The North pole of the first side magnet C may be oriented in substantially the same direction as the orientation of the North pole of the first magnet E (i.e., vertically upward). Meanwhile, the orientation of the North pole of the second side magnet B1 may be oriented toward the first magnet E.

This magnet configuration generates a strong axial magnetic field directed along the vertical direction of first magnet E. This axial magnetic field is ideal for magnetically releasing the pins from single clutch antitheft tags. By orienting the four magnets adjacent to first magnet E as shown in FIGS. 4A and 4B, an axial magnetic field is generated that is stronger than the magnetic field generated by the first magnet E alone. The magnetic field also extends for a length of one inch or longer so that magnet assembly 28 is capable of releasing double clutch antitheft tags.

In an example embodiment of the present invention, two additional magnets—second side magnet B1 and first side magnet C—are included in the magnet assembly 28 and placed adjacent to one of the magnets adjacent to the first magnet E (i.e., adjacent to magnet D as shown in FIGS. 3 and 4). First side magnet C is oriented such that it has the same magnetic orientation as the first magnet E and second side magnet B1 is oriented such that it has the same magnetic orientation as magnet D. A metal endplate A is placed on the end of the assembly. Such an assembly generates an elongated horizontal magnetic field that runs transverse to the axial magnetic field described previously, and can be used to magnetically release an antitheft device on an electronic media storage case. The vertical magnetic field is also strengthened by the presence of the side magnets. The resulting magnet assembly 28 can magnetically release a variety of common types of magnetically releasable antitheft devices.

As can be appreciated from FIGS. 3, 4A and 4B, the magnets B1, B2, C, and D may each be provided as rectangular prism shapes that have the same height and length dimensions. However, the widths of at least some of magnets B1, B2, C, and D may be different. In particular, the first side magnet C may be wider than magnets B2 and B1 (which may have equal widths). Meanwhile, magnets B2 and B1 may be wider than magnet D, which is in turn wider than the metal endplate A. The first magnet E may have the shape of a cylinder, and magnets F1 and F2 may fit over opposing sides of the first magnet E, spaced apart from each other. Thus, while magnets F1 and F2 may be substantially rectangular prism shaped, each such magnet may include a curved trench provided at a surface of at least a portion of the sidewalls that face each other to enable the magnets F1 and F2 to interface closely with the first magnet E. Magnets F1 and F2 may have the same height dimensions as magnets B1, B2, C, and D, but may have less than half the length of the magnets B1, B2, C, and D. The diameter of the first magnet E may be larger than the width of any of the other magnets B1, B2, C, D, F1 and F2.

In some embodiments, the magnet assembly 28 may sit on top of a non-ferromagnetic base plate (not shown). Alternatively, this base plate may be made of magnetic material in order to help shield a portion of the magnetic flux generated on the underside of the magnet assembly 28. The magnets may be made from a variety of magnetic materials, such as ferrite, samarium cobalt, or neodymium iron boron.

While one or more example embodiments of the present invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

That which is claimed:

1. A magnet assembly for decoupling different types of magnetically releasable antitheft devices, the magnet assembly comprising:

a first magnet having a magnetic orientation along a first direction;

a plurality of magnets adjacent to and surrounding the first magnet, the adjacent magnets defining an opening above the first magnet, each adjacent magnet having a magnetic orientation orthogonal to the first direction; and a first side magnet disposed adjacent one of the magnets adjacent to the first magnet on a side of the one of the magnets adjacent to the first magnet that is opposite from the first magnet, the first side magnet having the same magnetic orientation as the first magnet.

2. The magnet assembly of claim 1, further comprising a second side magnet disposed adjacent to the first side magnet, the second side magnet having a magnetic orientation orthogonal to that of the first magnet.

3. The magnet assembly of claim 2, wherein the first magnet has a cylindrical shape, an axis of the cylindrical shape being aligned with the first direction.

4. The magnet assembly of claim 3, wherein the first magnet has a height less than a height of each of the adjacent magnets, and wherein the height of the first magnet is less than a height of each of the first side magnet and the second side magnet.

5. The magnet assembly of claim 4, wherein a length of at least some of the adjacent magnets and a length of each of the first side magnet and the second side magnet are the same.

6. The magnet assembly of claim 5, wherein a first pair of the adjacent magnets is disposed to oppose each other relative to the first magnet and is also provided between a second pair of the adjacent magnets.

7. The magnet assembly of claim 6, wherein magnets of the first pair each have a first width that is larger than widths of magnets of the second pair.

8. The magnet assembly of claim 7, wherein magnets of the second pair have different widths relative to each other.

9. The magnet assembly of claim 8, wherein a diameter of the first magnet is larger than a width of any of the adjacent magnets and larger than a width of each of the first side magnet and the second side magnet.

10. A magnetic decoupling unit comprising:

a base unit;

a magnetic assembly; and a tether operably coupling the base unit and the magnet assembly, the magnet assembly comprising:

a first magnet having a magnetic orientation along a first direction;

a plurality of magnets adjacent to and surrounding the first magnet, the adjacent magnets defining an opening above the first magnet, each adjacent magnet having a magnetic orientation orthogonal to the first direction; and a first side magnet disposed adjacent one of the magnets adjacent to the first magnet on a side of the one of the magnets adjacent to the first magnet that is opposite from the first magnet, the first side magnet having the same magnetic orientation as the first magnet.

11. The magnetic decoupling unit of claim 10, further comprising a second side magnet disposed adjacent to the first side magnet, the second side magnet having a magnetic orientation orthogonal to that of the first magnet.

12. The magnetic decoupling unit of claim 11, wherein the first magnet has a cylindrical shape, an axis of the cylindrical shape being aligned with the first direction.

13. The magnetic decoupling unit of claim 12, wherein the first magnet has a height less than a height of each of the adjacent magnets, and wherein the height of the first magnet is less than a height of each of the first side magnet and the second side magnet.

14. The magnetic decoupling unit of claim 13, wherein a length of at least some of the adjacent magnets and a length of each of the first side magnet and the second side magnet are the same.

15. The magnetic decoupling unit of claim 14, wherein a first pair of the adjacent magnets is disposed to oppose each other relative to the first magnet and is also provided between a second pair of the adjacent magnets.

16. The magnetic decoupling unit of claim 15, wherein magnets of the first pair each have a first width that is larger than widths of magnets of the second pair.

17. The magnetic decoupling unit of claim 16, wherein magnets of the second pair have different widths relative to each other.

18. The magnetic decoupling unit of claim 17, wherein a diameter of the first magnet is larger than a width of any of the adjacent magnets and larger than a width of each of the first side magnet and the second side magnet.

* * * * *